US005918387A

United States Patent [19]

Emerson

[11] Patent Number: 5,918,387

[45] Date of Patent: Jul. 6, 1999

[54] SNOWSHOE HARNESS

[75] Inventor: Daniel T. Emerson, Palo Alto, Calif.

[73] Assignee: Atlas Snowshoe Company, San Francisco, Calif.

[21] Appl. No.: 09/010,199

[22] Filed: Jan. 21, 1998

[51] Int. Cl.[6] ..... A43B 5/04; A43B 5/16; A63C 9/00

[52] U.S. Cl. ..... 36/122; 280/623; 36/50.1

[58] Field of Search ..... 36/122, 50.1, 51, 36/123, 124, 125; 286/14.2, 617, 623

[56] References Cited

U.S. PATENT DOCUMENTS

| | | | |
|---|---|---|---|
| 5,440,827 | 8/1995 | Klebahn et al. . | |
| 5,493,794 | 2/1996 | McKenzie et al. | 36/122 |
| 5,503,900 | 4/1996 | Fletcher | 280/14.2 |
| 5,687,491 | 11/1997 | Klebahn . | |
| 5,699,630 | 12/1997 | Klebahn et al. . | |
| 5,740,621 | 4/1997 | Wing et al. | 36/122 |
| 5,820,139 | 10/1998 | Grindl | 280/14.2 |

*Primary Examiner*—Paul T. Sewell
*Assistant Examiner*—Anthony Stashick
*Attorney, Agent, or Firm*—Thomas M. Freiburger

[57] ABSTRACT

A harness system for a snowshoe employs a single strap and a single buckle to secure the boot to the snowshoe at two locations, one approximately at the arch and one at the toe. The single strap is secured to four points on the harness assembly, left and right sides of each of two flexible harness shells which engage both sides of the boot approximately in the arch and toe areas. Extending generally in a Z-shaped pattern in one embodiment, the strap is fixed at its one end and secured firmly but adjustably at its opposite end. At the two intermediate attachment points are sliding connections to anchoring devices at the ends of the harness legs. One of these sliding attachments may be on a buckle which is releasable, to release the strap from the boot. The harness assembly has the advantages of single-hand engagement and release, one-step engagement and release involving a single buckle, simpler assembly, and mechanical advantage in tightening the strap for adjustment or in engaging the over-center buckle.

19 Claims, 3 Drawing Sheets

SNOWSHOE HARNESS

BACKGROUND OF THE INVENTION

This invention concerns snowshoes, and in particular the invention relates to a harness assembly for retaining a user's boot securely on the snowshoe.

Snowshoes of the general type with which this invention is concerned are shown in U.S. Pat. Nos. 5,440,827, 5,699,630, and 5,687,491. Such snowshoes have included boot harness assemblies generally comprising a harness of flexible material extending up from a base, and a pair of straps engaged over the front of the shoe at spaced locations, each requiring separate operation of a buckle for the particular strap. These straps are often referred to as webbing. A heel strap, for passing horizontally around the back of the shoe or boot, also has been included to help retain the boot within the harness assembly.

Recent improvements have been made in the straps extending over the top of the boot in the harness assembly. One improvement has been the use of "switchback straps", one at each of the two over-the-boot locations, to gain a mechanical advantage in tightening of the strap. With the switchback harness straps, a strap is fixed at one side, passes through a common loop at the opposite side, and then back to the first side, where it is secured via a buckle or tightening device. When the strap is tightened, a 2:1 mechanical advantage is thus obtained.

In the present invention described below, a harness assembly employs, in part, the mechanical advantage principle described above, but in addition provides for a simpler design and assembly, as well as greater convenience in use by operation of only a single buckle for both strap locations on the harness assembly.

SUMMARY OF THE INVENTION

A snowshoe harness assembly according to the invention includes a base plate or cleat platform connected to the snowshoe frame and providing a platform on which the boot of a user can bear, and a harness comprising front and rear harness shells secured to the base plate and spaced apart fore and aft so that the front harness shell is approximately at the toe of the boot and the rear harness shell is approximately at the arch of the boot, each harness shell having left and right legs capable of partially wrapping around the boot when pulled tight against the boot. The four legs of the front and rear harness shell thus define four attachment points for tightening the harness against the user's boot to engage the boot securely in the snowshoe.

Connected to these four attachment points and serving as a webbing is a single strap which has a first end fixed to one leg of the toe harness shell and a second end secured to an opposite leg of the rear harness shell, at an opposite side of the snowshoe. The remaining two harness legs, i.e. the other leg of the front harness shell, and the other leg of the rear harness shell, have common loop attachments to the strap which allow the strap to slide through the common loop attachment when tightened or loosened. The single strap forms a Z-shaped strap pattern with one leg of the Z-shape spanning over the user's boot at the toe area, another leg of the Z spanning over the user's boot approximately above the arch, and a diagonal strap portion connecting the two common loop attachments, at strap apices. In addition, a release means is provided for a releasing the strap at one of the points of attachment, as well as an adjustment means for tightening or loosening the entire webbing strap from a single position.

In a preferred embodiment the release means is an over-center-type buckle which engages with a permanently installed clasp type member on the rear harness shell. The over-center buckle mechanism includes a common loop type pivot point through which the webbing (strap) loops in a sliding connection.

Also in a preferred embodiment, the adjustment means is at the second end of the strap, connected to said opposite end of the rear harness shell. This adjustment device may comprise a ladder lock buckle.

The harness assembly preferably also includes a heel band or strap, for passing horizontally around the back of the user's boot to better retain the boot in position in the harness assembly. This strap advantageously has a ratchet-type buckle device with a lever that advances and tightens the strap by one or more ratchet notches or teeth with each pivot stroke of the lever, while allowing quick release by pulling the lever back to an extreme position.

The single strap harness assembly of the invention provides a toe-area strap and an arch-area strap which act together to hold the user's boot firmly in the harness, with the harness secure against the boot. The harness assembly is simple in design, enables the user to secure the harness over the boot with one hand, and enables securing of the toe and arch strap sections in one step. In addition, mechanical advantage is provided by the common loop attachments and by the preferred over-center buckle.

These and other objects, advantages, and features of the invention will be apparent from the following description of preferred embodiments, considered with the accompanying drawings.

DESCRIPTION OF PREFERRED EMBODIMENTS

Figure 1:
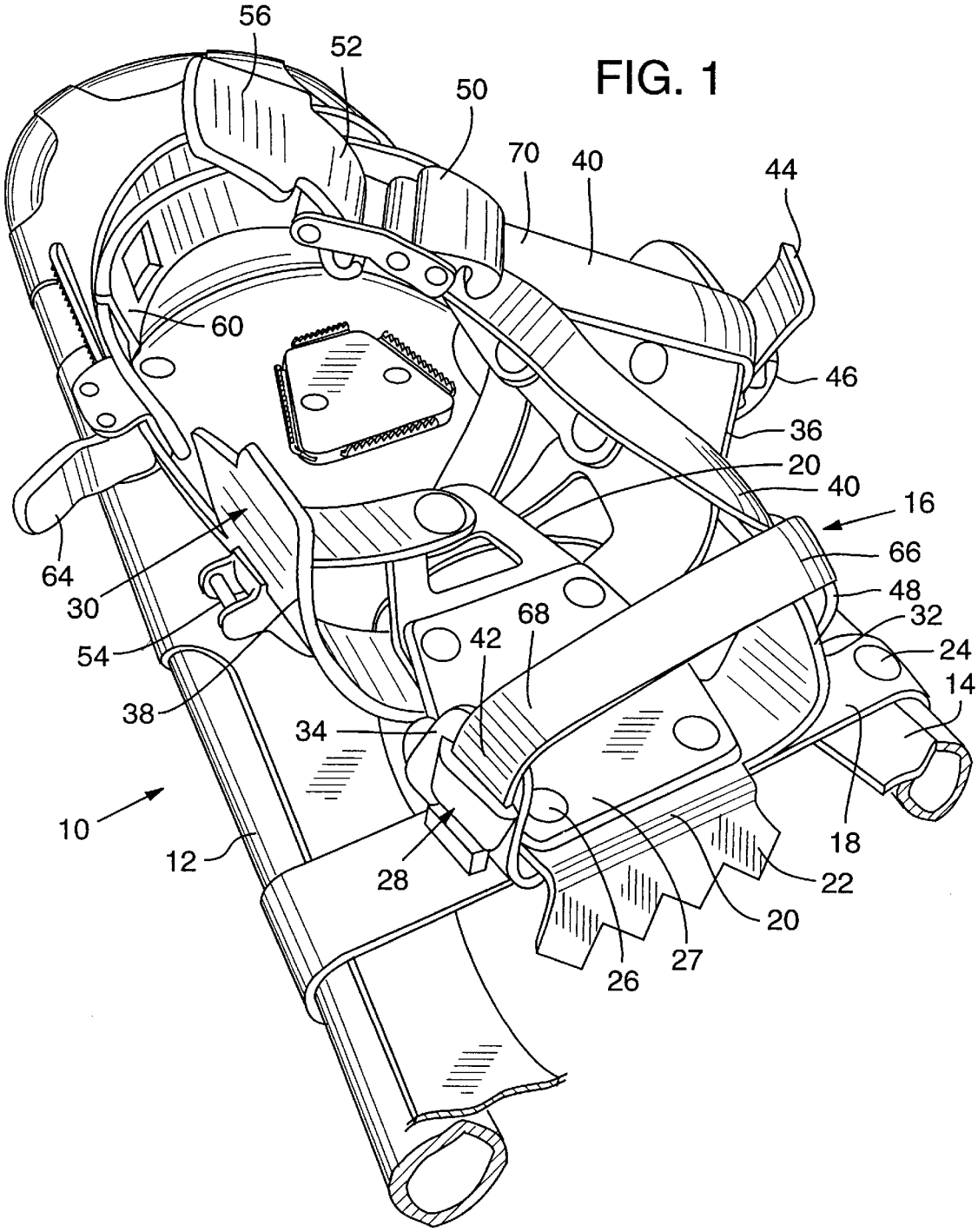
FIG. 1 is a perspective view showing a snowshoe with the harness assembly of the invention, the strap of the harness being held open.

In the drawings, FIG. 1 shows a portion of a snowshoe 10 having a frame 12 and decking 14 supported on the frame. A front harness assembly 16, for receiving and securing a user's boot, is attached to the snowshoe frame preferably in a pivot arrangement which comprise one or more flexible bands 18 connected to a base plate 20 which can also define a front claw 22 for engaging terrain. The strap suspension for the harness assembly may be similar to that shown in U.S. Pat. No. 5,440,827.

As shown in the drawings, connections can be made by rivets (as at 24 and 26, for example), and the base plate can have a footbed 27, which may be contoured for the bottom of a shoe, affixed to its upper surface. The molded footbed may be as shown in U.S. Pat. No. 5,687,491.

To the baseplate 20 is attached a harness, preferably comprising front and rear harness shells 28 and 30. Each of the front and rear harness shells has left and right legs extending up for partially wrapping around the user's boot. These include left and right legs 32 and 34 on the front webbing 28, and left and right legs 36 and 38 on the rear webbing 30.

Figure 2:
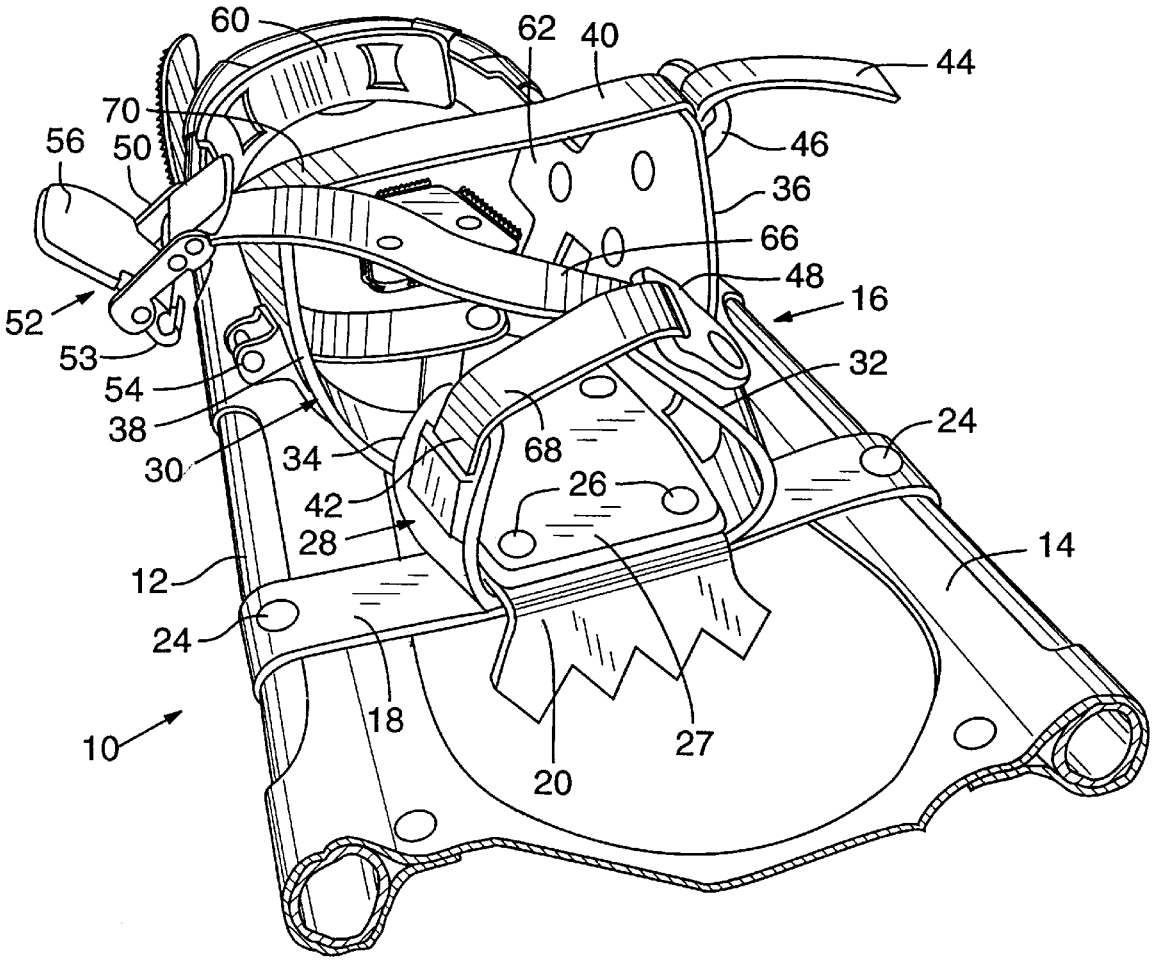
FIG. 2 is another perspective view of the invention, showing the harness assembly in an almost-closed position.

These four legs provide attachment points for a strap 40 which serves as a webbing to secure the boot to the base plate 20 of the harness assembly. The term "webbing" is used in a broad sense to include a webbing of straps formed as shown, and also a webbing of flexible, injection molded plastic such as urethane, and webbings formed from cables. As shown in FIGS. 1 and 2, the strap 40 has a first end 42 which is permanently fixed to one of the legs 32 and 34 of the front harness shell, and in this case it is shown as being fixed to the front right leg 34. The strap has an opposite end 44 which is secured to the leg of the rear harness shell, at the side of the snowshoe opposite that at which the first end of the strap is secured (i.e. at a diagonally opposed position). At the second end 44, the strap preferably is secured via an adjustment device 46, which in a preferred embodiment is a ladder lock buckle. Alternatively, the buckle could be a ratchet device for advancing the strap with each successive operation of a lever, and providing for release of strap tension by a different movement of the lever (such as pulling the lever hard back). An example of a ladder lock buckle is that sold under the name Tensionlock by National Molding Corporation, Farmingdale, N.Y.; an example of a ratchet type buckle is an SBS Mega Type K buckle sold by Gudo Ag of Switzerland.

Between the two ends of the strap, the strap stretches in a generally Z-shaped configuration as shown. The other two strap attachment points, at the harness legs 32 and 38, are sliding attachments, via common loop type brackets 48 and 50. One of these preferably is releasable from the respective harness leg, and this is most advantageously the harness leg 38. At that leg, the strap is secured to an over-center type buckle 52, which is in turn secured to the common loop bracket 50 where the strap forms an apex in the Z-configuration. The over-center buckle is of the common type which has a hooked end 53 (FIG. 2) which engages with a bar or other clasp type member 54 on the harness leg 38, after which the lever device 56 of the over-center buckle 52 can be pushed down to pull the strap assembly tightly, placing tension in the strap so as to engage the harness assembly over the boot.

The drawings also show a heel strap or band 60 for engaging around the back of the boot, to secure the boot against slipping back within the harness assembly 16. The strap is secured to tabs 62 extending rearward from the back of the webbing, one end of the strap or band 60 being fixed and the other connected by an appropriate form of buckle. A lever type buckle is shown at 64 in FIG. 1, and this may be a ratchet type buckle as described above, with each stroke of the lever tightening the band by a notch on a rack of teeth or notches. Preferably the buckle 64 allows complete release of the rear strap or band.

As can be seen from the drawings, the Z configuration of the strap 40 of the harness assembly, with a diagonal middle portion 66 which is fitted through common loop attachments 50 and 48 at each end enables several advantages: (1) the user can attach the strap to the harness assembly with one hand, (2) the user can engage and release the webbing in one step, for both toe and arch securement, once the strap has been adjusted to the user, and (3) there is some mechanical advantage in the illustrated arrangement, both in tightening adjustment and in buckling of the strap. In adjustment of the strap, using the adjustment device 46 which preferably comprises a ladder lock buckle, mechanical advantage is gained as to drawing together of the front harness shell 28, with the front Z leg 68, and in drawing together of the rear shell 30, with the rear Z leg 70. A 2:1 mechanical advantage is gained as to drawing the rear harness shell leg 38 toward the opposite leg, in that (assuming the front harness shell 28 to be fully tightened) the strap movement in the strap leg 70 as it is drawn by the adjustment device 46 is halved in movement of the common loop connection 50 at the opposite side. Similarly, if the rear shell 30 is assumed to be fully tightened, the length of movement of the diagonal section of strap 66 is essentially halved at the common loop bracket connection 48 at the left front harness leg 32 (although the angle at the strap apex at this connection 48 will reduce the 2:1 ratio somewhat).

In use of the over-center buckle 56 to buckle the strap over a boot, mechanical advantage is gained as to the drawing of the front harness legs 32 and 34, which is important in that the central diagonal section 66 of strap encounters some friction in riding over the boot. No similar mechanical advantage is gained by the Z arrangement in closing the rear harness shell together using the buckle 56; however, the over-center buckle itself provides considerable mechanical advantage and appreciable displacement or reach (e.g. about 1⅛ inch for a buckle having an overall length of about 3 inches) which is adequate to tightly engage the straps over the user's boot without a great deal of manual pressure, once the strap has been adjusted for the particular boot. Generally the end 44 of the strap, i.e. the harness shell 36, should be at the arch side of the foot, since this is the most aft part of the harness.

Figure 3:
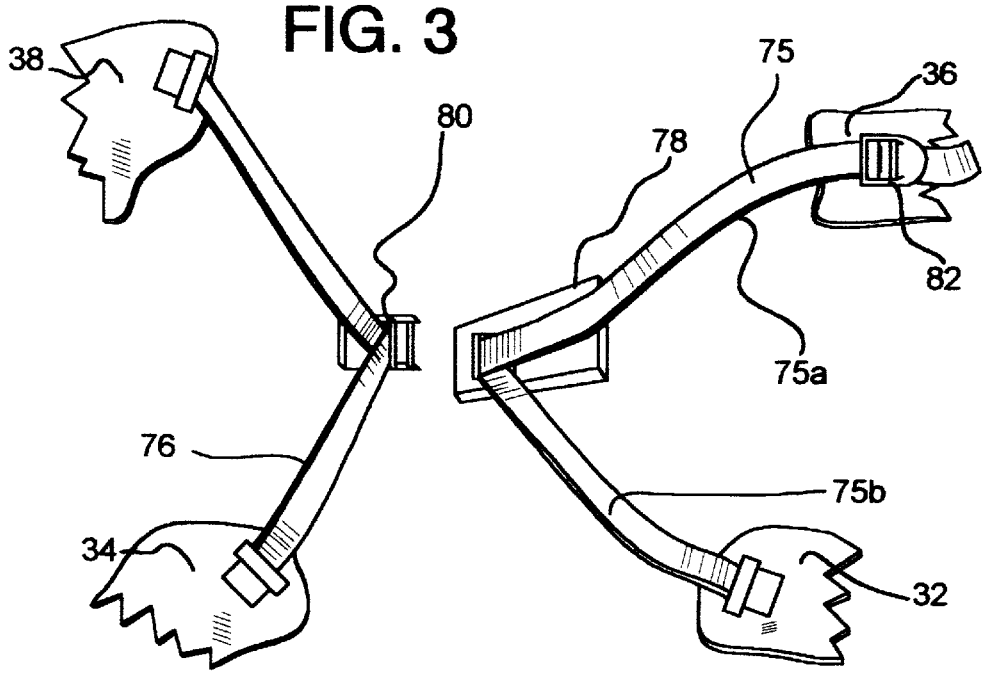
FIG. 3 is a schematic view showing another embodiment of the invention.

Another configuration of a harness strap assembly is shown schematically in FIG. 3. In FIG. 3 the lower end of the drawing is the toe end of the harness assembly and a right foot configuration is shown. The figure indicates the front harness legs 32 and 34 and the rear harness legs 36 and 38. In this configuration, two straps form the securing configuration for the harness assembly. The left side strap (on the right side of FIG. 3) 75 is secured to the left side harness legs 36 and 32, and this is preferably of greater length than a right side strap 76 which is secured to the right side harness legs 38 and 34. A single buckle 78, advantageously comprising an over-center-type buckle as described above, is secured to the strap 75, and a buckle receiving clip 80 is secured to the shorter, right-side strap 76. The buckle 78 is placed off-center, with the strap 75 considerably longer than the strap 76, so that the buckle does not engage directly on top of the foot. This allows arch and toe strap portions 75*a* and 75*b* to be oriented at a relatively small angle with respect to a transverse line across the snowshoe. The harness legs on the right side of the harness assembly can be formed so that the legs 34 and 38 are shorter than those at the opposite side of the snowshoe if desired, to accommodate a greater length of strap 75.

For adjustment, one end of one of the straps, preferably the end of the strap 75 at the rear left harness leg 36, includes a strap adjustment device. This is indicated at 82, and can comprise a ladder lock buckle of the type described above. Because of the adjustment at this end of the strap 25, the buckle 78 and the receiving clip 80 are secured to the straps 75 and 76 with a slidable, common loop connection.

Figure 4:
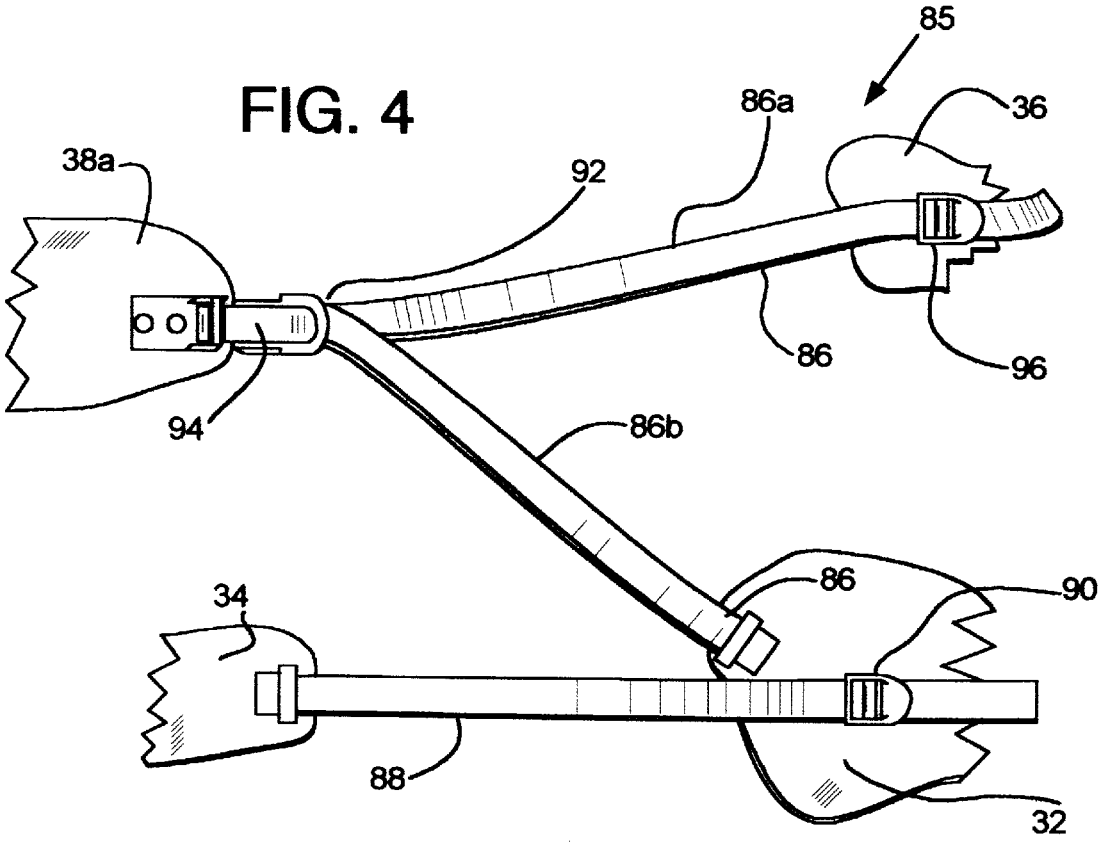
FIG. 4 is another schematic view, showing a further embodiment of the invention.

FIG. 4 shows schematically another alternative configuration for a webbing strap arrangement in a harness of the invention. FIG. 4 shows the front harness legs 32 and 34, and a left rear harness leg 36 and a right rear harness leg 38*a*, which is displaced slightly forward from the position of the rear harness leg 38 in the earlier described embodiments.

The webbing assembly 85 of FIG. 4 includes a strap 86 which extends back and forth in a V configuration, with a rear strap leg 86*a* and a forward strap leg 86*b*. At the toe area of the harness is a separate strap 88, which preferably is a molded urethane strap, relatively stiff but still having flexibility for adjustment and release. This strap in a preferred embodiment has a ladder lock or ratchet type buckle 90 for tightening or releasing the toe strap 88. This strap is permanently secured at the right front harness attachment point 34, although this connection can be pivotable.

The strap 86 preferably is fixed to the harness attachment point 32, and at a strap apex 92 of the strap 86, there is secured (in a common loop attachment) a buckle such as an over-center buckle type 94. For adjustment of the V strap 86's length, a strap adjustment device 96 preferably is included at the attachment point 36, and this may be a ladder lock buckle.

Like the strap arrangement shown in FIG. 3, FIG. 4 shows a configuration for the right foot of a user. Because of the location and orientation of the attachment points, it is important that the harness leg attachment point 36 be at the arch side of the foot, for a secure engagement of the boot in that region. The harness attachment point 38*a* is at the outer side of the foot, as is the forward point 34.

In a variation of the webbing configuration 85 described with respect to FIG. 4, the V shaped strap 86 can be an injection molded, relatively stiff webbing element, similar to the strap 88. In that case, the adjustment 96 is eliminated, and the buckle 94 is advantageously one which provides for adjustment, such as a ladder lock or ratchet type buckle or a buckle with a ratcheting strap in conjunction with a ladder lock buckle.

The above described preferred embodiments are intended to illustrate the principles of the invention, but not to limit its scope. Other embodiments and variations to this preferred embodiment will be apparent to those skilled in the art and may be made without departing from the spirit and scope of the invention as defined in the following claims.

I claim:

1. A harness assembly for a snowshoe, the snowshoe including a snowshoe frame and a deck secured to the frame, said harness assembly comprising:

a base plate for the harness assembly, providing a platform on which the boot of a user can bear, and including means supporting the base plate on the snowshoe frame, a front harness shell and a rear harness shell of flexible material secured to the base plate, the two harness shells being spaced apart so that the front harness shell is approximately at the toe of the boot and the rear harness shell is approximately at the arch of the boot, and each harness shell having left and right legs capable of partially wrapping around the boot when pulled tight against the boot, the four legs of the front and rear harness shells defining four attachment points for tightening the harness shells against the user's boot to engage the boot securely in the snowshoe, a single strap secured to the four attachment points, the strap having a first end fixed to one leg of the first harness shell and a second end secured to an opposite leg of the rear harness shell, at an opposite side of the snowshoe from the first strap end, and the other leg of the front harness shell and the other leg of the rear harness shell having common loop attachment means to the strap, for allowing the strap to slide through the common loop attachment when the strap is tightened or loosened, thereby forming a Z-shaped strap pattern with one leg of the Z shape spanning over the user's boot at the toe area, another leg of the Z shape spanning over the user's boot approximately above the arch, and a diagonal strap portion connecting the two common loop attachment means, and release means for releasing the strap at one of the points of attachment, and adjustment means for tightening or loosening the entire strap from a single position.

2. The harness shell assembly of claim 1, wherein the release means comprises a buckle secured to the common loop at said other leg of the rear harness shell.

3. The harness assembly of claim 2, wherein the buckle comprises an over-center buckle with mechanical advantage.

4. The harness assembly of claim 2, wherein the adjustment means is on said other leg of the rear harness shell and at the second end of the strap.

5. The harness assembly of claim 1, wherein the adjustment means is on said other leg of the rear harness shell and at the second end of the strap.

6. The harness assembly of claim 5, wherein the adjustment means comprises a ladder lock buckle.

7. The harness assembly of claim 1, further including a heel strap means for engaging around the back of the user's boot.

8. The harness assembly of claim 7, wherein the heel strap means includes a ratchet type buckle positioned for tightening or releasing the heel strap means.

9. A harness assembly for a snowshoe which includes a snowshoe frame, the harness assembly comprising:

a foot bearing base against which a user's boot is placed, supported on the snowshoe frame, a harness connected to the base and positioned to partially envelop the user's boot by wrapping over the sides of the boot when tightened thereon, the harness having four attachment points for a webbing to draw the harness together against the boot, including left and right front attachment points and left and right rear attachment points, a harness webbing comprising a single strap connected to all four attachment points in a Z configuration, which defines a strap leg spanning over the user's boot at the toe area, between the front attachment points, and a strap leg spanning over the user's boot approximately above the arch, between the rear attachment points, and further defining a diagonal strap portion extending from a rear strap apex at an attachment point on one side of the harness to a front strap apex at an attachment point at the opposite side of the harness, means for releasing the webbing from the user's boot, and means for tightening the webbing to pull the harness against the boot.

10. The harness assembly of claim 9, wherein the harness comprises a front harness shell with said front two attachment points, and a rear harness shell with said rear two attachment points, each being of flexible material and connected to the foot bearing base.

11. The harness assembly of claim 9, wherein the webbing release means comprises a buckle connected to the strap at said rear strap apex, in a common loop attachment allowing sliding movement of the strap, the buckle being capable of attachment to and release from the harness at the attachment point.

12. The harness assembly of claim 11, wherein the strap is secured at said front strap apex to the harness attachment point by a common loop attachment, allowing sliding of the strap relative to the attachment point.

13. The harness assembly of claim 11, wherein the buckle comprises an over-center buckle.

14. The harness assembly of claim 9, wherein the means for tightening the webbing comprises an adjustable strap tightening and loosening device at the rear attachment point opposite said strap apex.

15. The harness assembly of claim 14, wherein the tightening means for the web comprises a ladder lock buckle.

16. A harness assembly for a snowshoe which includes a snowshoe frame, the harness assembly comprising:

a foot bearing base against which a user's boot is placed, supported on the snowshoe frame, a harness connected to the base and positioned to partially envelop the user's boot by wrapping over the sides of the boot when tightened thereon, the harness having four attachment points for a webbing to draw the harness together against the boot, two attachment points at left and two attachment points at right, a harness webbing including a strap connected to two attachment points at one side of the snowshoe and to one attachment point at the opposite side of the snowshoe, forming a V shape with two legs of the straps crossing back and forth across the harness with a strap apex at said opposite side, and buckle means for securing and releasing the strap at the apex of the strap.

17. The harness assembly of claim 16, wherein the harness webbing further includes a toe region strap for connecting two of the attachment points at left and right of the forward end of the harness webbing, said toe area strap being fixed to an attachment point at one end and releasable and adjustable at an opposite end.

18. The harness assembly of claim 17, wherein said toe area strap is of molded plastic material, and wherein said releasing and adjusting means comprises a ratchet type buckle.

19. The harness assembly of claim 17, wherein said apex of the strap is at the outer side of the user's boot, opposite the arch side of the boot.

* * * * *